US011675286B2

(12) United States Patent
Nakajima

(10) Patent No.: US 11,675,286 B2
(45) Date of Patent: Jun. 13, 2023

(54) IMAGE FORMING APPARATUS CONFIGURED TO DETERMINE ABNORMALITY OF DRUM UNIT EARTH TERMINAL

(71) Applicant: CANON KABUSHIKI KAISHA, Tokyo (JP)

(72) Inventor: Hirohisa Nakajima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/580,487

(22) Filed: Jan. 20, 2022

(65) Prior Publication Data

US 2022/0244659 A1 Aug. 4, 2022

(30) Foreign Application Priority Data

Feb. 4, 2021 (JP) ..... JP2021-016510

(51) Int. Cl.
*G03G 15/02* (2006.01)
*G03G 15/00* (2006.01)

(52) U.S. Cl.
CPC ..... *G03G 15/0266* (2013.01); *G03G 15/55* (2013.01)

(58) Field of Classification Search
CPC . G03G 15/0266; G03G 15/55; G03G 15/5037
See application file for complete search history.

(56) References Cited

U.S. PATENT DOCUMENTS 10,025,218 B2 * 7/2018 Nakajima ..... G03G 15/0266

FOREIGN PATENT DOCUMENTS

| | | | |
|---|---|---|---|
| JP | 2003208062 A | * | 7/2003 |
| JP | 2004138838 A | | 5/2004 |
| JP | 2006350010 A | * | 12/2006 |
| JP | 2007248831 A | * | 9/2007 |

* cited by examiner

*Primary Examiner* — Arlene Heredia
(74) *Attorney, Agent, or Firm* — Canon U.S.A., Inc. I.P. Division

(57) ABSTRACT

An image forming apparatus includes a drum unit, a charging roller, a detector, a controller, a developing unit, and a notification unit. The drum unit includes an earth terminal connected to a housing of the image forming apparatus. The detector detects an amplitude of a first alternating-current voltage output to the charging roller. The controller controls so that an amplitude deviation between the first alternating-current voltage amplitude and an output target value of the first alternating-current voltage amplitude is made small. The developing unit develops an electrostatic latent image on the drum unit based on a second alternating-current voltage. The notification unit notifies an abnormality of the earth terminal based on the amplitude deviation in a first state where the first alternating-current voltage is output and the second alternating-current voltage is not output, and the amplitude deviation in a second state where the first and second alternating-current voltages are output.

6 Claims, 8 Drawing Sheets

WHEN DRUM EARTH TERMINAL IS NORMALLY CONNECTED

WHEN DRUM EARTH TERMINAL IS POORLY CONNECTED

WHEN DRUM EARTH TERMINAL IS NORMALLY CONNECTED

WHEN DRUM EARTH TERMINAL IS POORLY CONNECTED

WHEN DRUM EARTH TERMINAL IS NORMALLY CONNECTED

WHEN DRUM EARTH TERMINAL IS POORLY CONNECTED

IMAGE FORMING APPARATUS CONFIGURED TO DETERMINE ABNORMALITY OF DRUM UNIT EARTH TERMINAL

BACKGROUND

Field

The present disclosure relates to an image forming apparatus that forms an image on a photosensitive body by using a charging roller and a developing unit.

Description of the Related Art

There is known a conventional image forming apparatus that charges a photosensitive drum, exposes a surface of the charged photosensitive drum with a laser beam to form an electrostatic latent image on the surface, and develops the formed electrostatic latent image to form an image.

The photosensitive drum includes a conductive portion and a photosensitive portion formed on a surface layer of the conductive portion. The conductive portion is provided with a terminal (a drum earth terminal) for grounding the photosensitive drum. When the drum earth terminal grounds the photosensitive drum through a housing of the image forming apparatus, image formation on the surface of the photosensitive drum is appropriately performed. If a poor connection occurs between the drum earth terminal and the housing of the image forming apparatus, the photosensitive drum is not grounded, and the image formed on the surface of the photosensitive drum is disturbed.

Japanese Patent Application Laid-Open No. 2004-138838 discusses a configuration that detects a poor connection between a terminal for grounding a photosensitive drum and a housing of an image forming apparatus, based on a current flowing through a high-voltage circuit.

With the configuration discussed in Japanese Patent Application Laid-Open No. 2004-138838, to determine whether a poor connection has occurred between the terminal for grounding the photosensitive drum and the housing of the image forming apparatus, a configuration for detecting the current needs to be additionally provided in the high-voltage circuit. In other words, the configuration discussed in Japanese Patent Application Laid-Open No. 2004-138838 causes a cost increase.

SUMMARY

The present disclosure is directed to determining an abnormality of an earth terminal with a more inexpensive configuration.

According to an aspect of the present disclosure, an image forming apparatus configured to form an image on a recording medium includes a drum unit including a conductive portion and a photosensitive body, wherein the conductive portion is provided with an earth terminal configured to ground the conductive portion by being connected to a housing of the image forming apparatus, a charging roller configured to charge the photosensitive body based on a first alternating-current voltage, a detector configured to detect an amplitude of the first alternating-current voltage output to the charging roller, a controller configured to control the first alternating-current voltage to be output to the charging roller so that an amplitude deviation between the amplitude of the first alternating-current voltage detected by the detector and a target value of the amplitude of the first alternating-current voltage to be output to the charging roller is made small, a scanning unit including a light source and configured to scan the photosensitive body charged by the charging roller, with light emitted from the light source based on the image to be formed on the recording medium, a developing unit configured to develop an electrostatic latent image formed on the photosensitive body by the scanning unit, based on a second alternating-current voltage, and a notification unit configured to provide notification of information indicating an abnormality of the earth terminal, based on a value corresponding to a first deviation and a value corresponding to a second deviation, wherein the first deviation is the amplitude deviation in a state where the first alternating-current voltage is output to the charging roller and the second alternating-current voltage is not output to the developing unit, and the second deviation is the amplitude deviation in a state where the first alternating-current voltage is output to the charging roller and the second alternating-current voltage is output to the developing unit.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. Shapes, relative arrangement, and the like of components described in the exemplary embodiments may be appropriately modified depending on a configuration of an apparatus to which any of the exemplary embodiments is applied and various conditions, and the scope of the present disclosure is not intended to be limited to the exemplary embodiments described above.

[Image Forming Apparatus]

Figure 1:
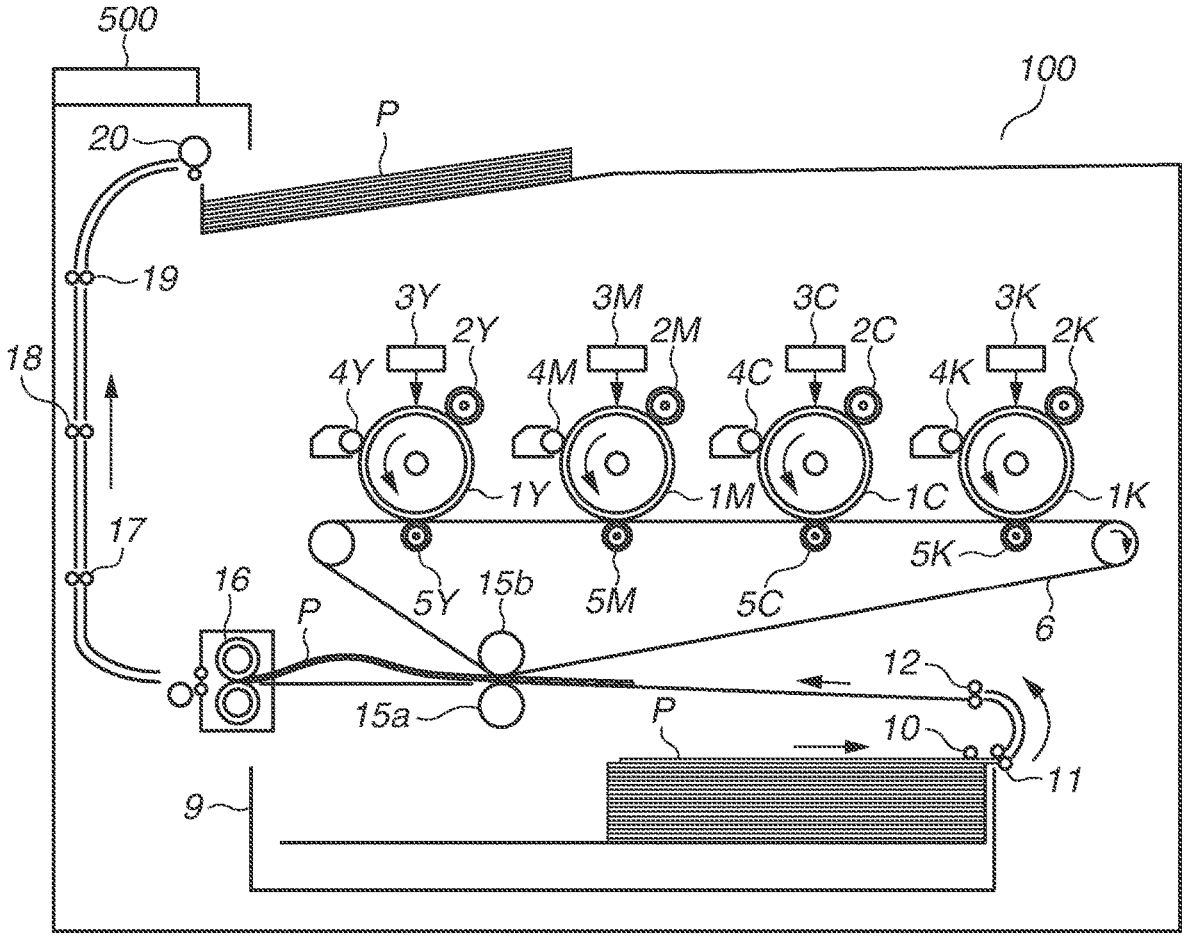
FIG. 1 is a cross-sectional view illustrating an image forming apparatus according to a first exemplary embodiment.

FIG. 1 is a cross-sectional view illustrating a configuration of a color electrophotographic copier (hereinafter referred to as an image forming apparatus) 100 used in a first exemplary embodiment of the present disclosure. The image forming apparatus 100 is not limited to the copier, and may be, for example, a facsimile apparatus, a printing machine, or a printer. In addition, the recording method is not limited to the electrophotographic method, and may be, for example, an inkjet method. Furthermore, the type of the image forming apparatus 100 may be either a monochrome type or a color type.

The configuration and functions of the image forming apparatus 100 will be described next with reference to FIG. 1.

A sheet storage tray 9 for storing a recording medium P is provided inside the image forming apparatus 100. The recording medium P is a medium on which an image is to be formed by the image forming apparatus 100. For example, a paper sheet, a resin sheet, a cloth, an overhead projector (OHP) sheet, and a label are included in the recording medium P.

The recording medium P stored in the sheet storage tray 9 is fed by a pickup roller 10, and is conveyed to registration rollers 12 by conveyance rollers 11.

Image signals output from an external apparatus such as a personal computer (PC) are input to light scanning devices 3Y, 3M, 3C, and 3K for respective color components. Each of the light scanning devices 3Y, 3M, 3C, and 3K includes a semiconductor laser and a polygon mirror. More specifically, a yellow image signal output from the external apparatus is input to the light scanning device 3Y, and a magenta image signal output from the external apparatus is input to the light scanning device 3M. A cyan image signal output from the external apparatus is input to the light scanning device 3C, and a black image signal output from the external apparatus is input to the light scanning device 3K.

While a configuration for forming a yellow image is described below, a configuration for forming each of magenta, cyan, and black images is similar to the configuration for forming the yellow image.

A photosensitive drum 1Y serving as a drum unit includes a conductive portion and a photosensitive portion provided on a surface of the conductive portion. The conductive portion is provided with a drum earth terminal (an earth terminal) which is a terminal for grounding the photosensitive drum 1Y. The photosensitive drum 1Y is grounded through connection between the drum earth terminal and a housing of the image forming apparatus 100.

A charging unit 2Y is connected to a high-voltage power supply (not illustrated), and a charging bias in which a sinusoidal alternating-current (AC) voltage as a first AC voltage is superimposed on a direct-current (DC) voltage as a first DC voltage is applied to the charging unit 2Y. The charging unit 2Y includes a charging roller. The photosensitive portion (the outer peripheral surface of the photosensitive drum 1Y) is charged by the charging unit 2Y. After the outer peripheral surface of the photosensitive drum 1Y is charged, a laser beam corresponding to the image signal input from the external apparatus to the light scanning device 3Y is applied from the light scanning device 3Y to the outer peripheral surface of the photosensitive drum 1Y through an optical system such as the polygon mirror. As a result, an electrostatic latent image is formed on the outer peripheral surface of the photosensitive drum 1Y.

A developing unit 4Y is connected to a high-voltage power supply (not illustrated), and a developing bias in which a sinusoidal AC voltage as a second AC voltage is superimposed on a DC voltage as a second DC voltage is applied to the developing unit 4Y. The electrostatic latent image is developed using toner of the developing unit 4Y by the developing bias, so that a toner image is formed on the outer peripheral surface of the photosensitive drum 1Y. The toner image formed on the photosensitive drum 1Y is transferred onto a transfer belt 6 by a transfer roller 5Y provided at a position facing the photosensitive drum 1Y.

The yellow, magenta, cyan, and black toner images transferred to the transfer belt 6 are transferred onto the recording medium P by a pair of transfer rollers 15*a* and 15*b*. In synchronization with this transfer timing, the registration rollers 12 feed the recording medium P between the pair of transfer rollers 15*a* and 15*b*.

The recording medium P to which the toner images have been transferred in the above-described manner is fed into a fixing unit 16 and is heated and pressurized by the fixing unit 16. As a result, the toner images are fixed to the recording medium P. In this manner, the image forming apparatus 100 forms an image on the recording medium P. The recording medium on which the image has been formed is discharged to the outside of the image forming apparatus 100 by conveyance rollers 17, 18, 19, and 20.

The above is the description of the configuration and the functions of the image forming apparatus 100.

[High-Voltage Control Configuration in Image Forming Apparatus]

Figure 2:
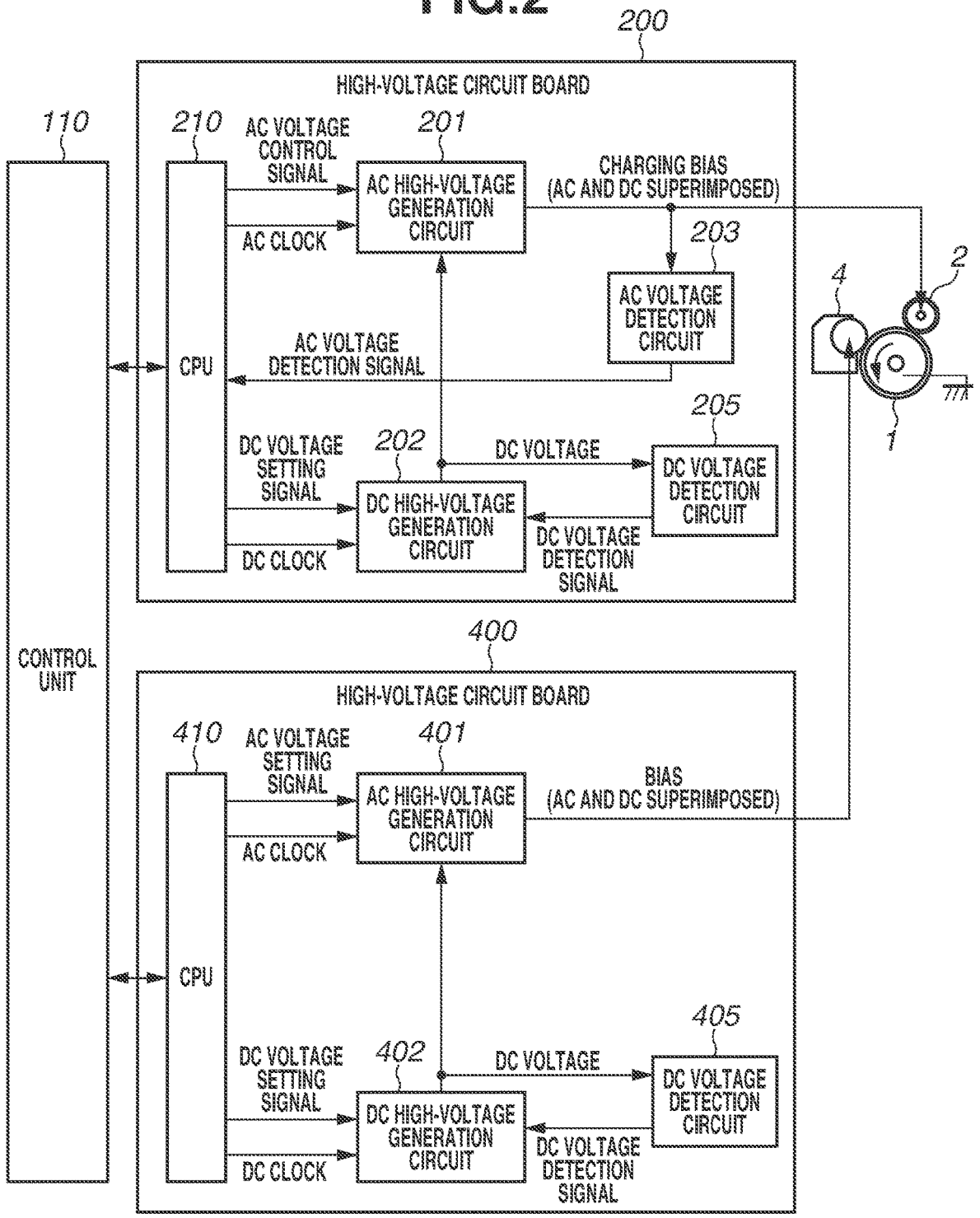
FIG. 2 is a block diagram illustrating an example of a high-voltage control configuration according to the first exemplary embodiment.

FIG. 2 is a block diagram illustrating an example of a configuration for high-voltage control in the image forming apparatus 100. As illustrated in FIG. 2, the image forming apparatus 100 includes a high-voltage circuit board (or a charging high-voltage circuit board) 200 for controlling a voltage to be applied to the charging unit 2Y, and a high-voltage circuit board (or a developing high-voltage circuit board) 400 for controlling a voltage to be applied to the developing unit 4Y.

A control unit 110 transmits, to a central processing unit (CPU) 210, information about an amplitude and a frequency of an AC voltage to be applied to the charging unit 2Y and information about a magnitude of a DC voltage to be applied to the charging unit 2Y. The CPU 210 outputs an AC clock and an AC voltage control signal (a charging AC voltage control signal) to an AC high-voltage generation circuit 201 based on the information output from the control unit 110.

The AC high-voltage generation circuit 201 generates the AC voltage based on the AC clock and the AC voltage control signal output from the CPU 210. The AC clock and the AC voltage control signal will be described below.

An AC voltage detection circuit 203 detects a peak-to-peak voltage (Vpp) of the AC voltage output from the AC high-voltage generation circuit 201, and inputs an AC voltage detection signal corresponding to the detected peak-to-peak voltage Vpp to the CPU 210.

The CPU 210 performs feedback control so as to reduce a deviation between the amplitude of the AC voltage output from the control unit 110 and an amplitude based on the peak-to-peak voltage Vpp indicated by the AC voltage detection signal input from the AC voltage detection circuit 203.

A DC high-voltage generation circuit 202 outputs the predetermined DC voltage based on a DC clock and a DC voltage setting signal output from the CPU 210. The DC clock is a clock signal having a fixed duty cycle, and is a signal for turning on or off a DC transformer inside the DC high-voltage generation circuit 202.

A DC voltage detection circuit 205 detects the DC voltage output from the DC high-voltage generation circuit 202, and inputs a DC voltage detection signal corresponding to a value of the detected voltage to the DC high-voltage generation circuit 202.

The DC high-voltage generation circuit 202 performs feedback control so as to reduce a deviation between the magnitude of the DC voltage output from the CPU 210 and the DC voltage detection result input from the DC voltage detection circuit 205.

The voltage in which the AC voltage generated by the AC high-voltage generation circuit 201 is superimposed on the DC voltage generated by the DC high-voltage generation circuit 202 is applied to the charging unit 2Y.

The control unit 110 outputs, to a CPU 410, information about an amplitude and a frequency of an AC voltage to be applied to the developing unit 4Y and information about a magnitude of a DC voltage to be applied to the developing unit 4Y. The CPU 410 outputs an AC clock and an AC voltage setting signal to an AC high-voltage generation circuit 401 based on the information output from the control unit 110.

The AC high-voltage generation circuit 401 outputs the AC voltage based on the AC clock and the AC voltage setting signal output from the CPU 410. The AC clock is a signal input to the AC high-voltage generation circuit 401 so as to convert the AC voltage into a square wave voltage of a predetermined frequency.

The AC voltage setting signal is set based on a target amplitude value of the AC voltage in a preset table. The AC high-voltage generation circuit 401 controls the AC voltage to be applied to the developing unit 4Y by performing open-loop control.

A DC high-voltage generation circuit 402 outputs the predetermined DC voltage based on a DC clock and a DC voltage setting signal output from the CPU 410. The DC clock is a clock signal having a fixed duty cycle, and is a signal for turning on or off a DC transformer inside the DC high-voltage generation circuit 402.

A DC voltage detection circuit 405 detects the DC voltage output from the DC high-voltage generation circuit 402, and inputs a DC voltage detection signal corresponding to a value of the detected voltage to the DC high-voltage generation circuit 402.

The DC high-voltage generation circuit 402 performs feedback control so as to reduce a deviation between the DC voltage setting signal output from the CPU 410 and the DC voltage detection signal input from the DC voltage detection circuit 405.

The voltage in which the AC voltage generated by the AC high-voltage generation circuit 401 is superimposed on the DC voltage generated by the DC high-voltage generation circuit 402 is applied to the developing unit 4Y.

Figure 3:
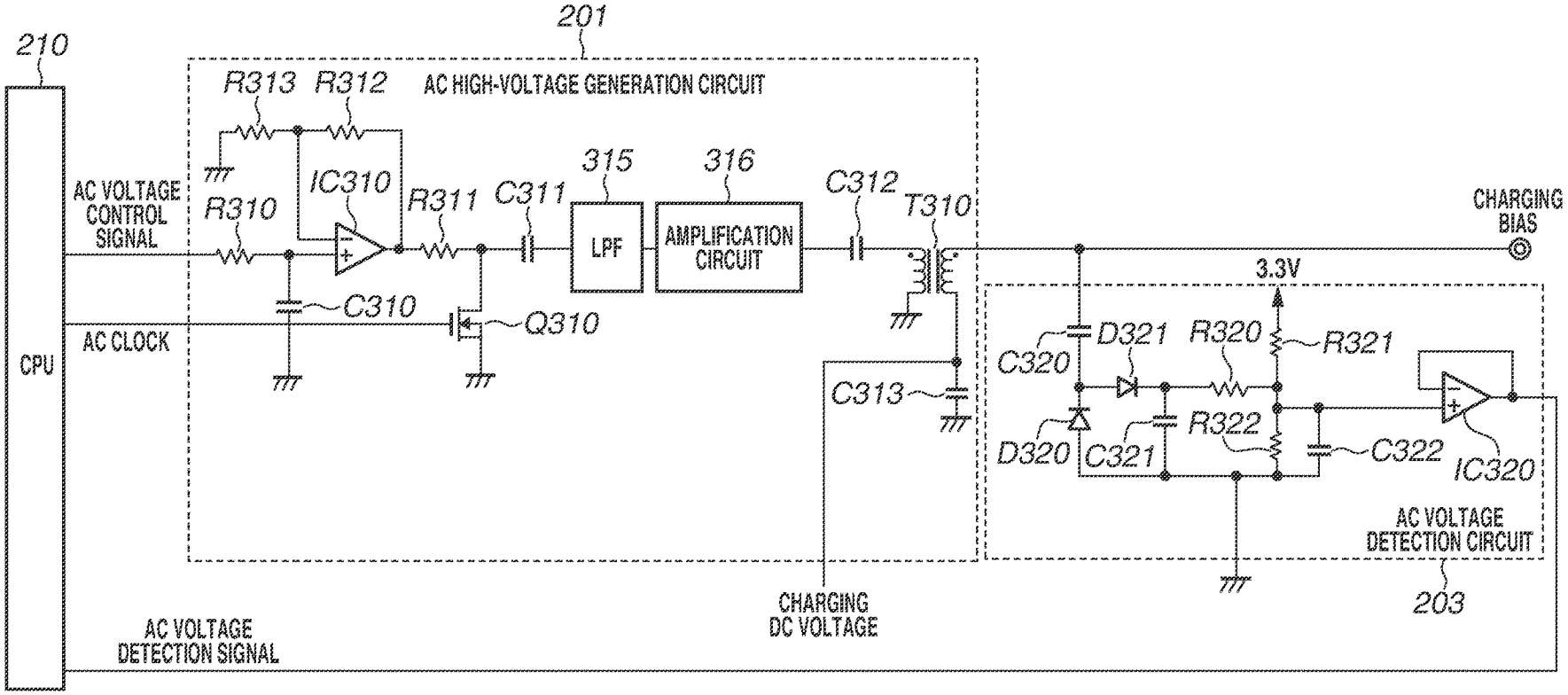
FIG. 3 is a diagram illustrating details of an alternating-current (AC) high-voltage generation circuit in charging and an AC voltage detection circuit in charging according to the first exemplary embodiment.

FIG. 3 illustrates details of the AC high-voltage generation circuit 201 and the AC voltage detection circuit 203. In the present exemplary embodiment, the charging bias in which a sinusoidal AC voltage having an amplitude of 700 V is superimposed on a DC voltage of −600 V will be described as an example. The charging bias is the voltage in which the DC voltage and the AC voltage are superimposed as described above, and has a sine wave oscillating in a range of −1300 V to +100 V.

As described above, the AC high-voltage generation circuit 201 outputs the sinusoidal AC voltage based on the AC clock and the AC voltage control signal. The charging AC voltage control signal is a pulse width modulation (PWM) signal having a variable duty cycle, and is determined by the feedback control of the CPU 210. The amplitude of the AC voltage is reduced as the duty cycle is lowered.

The AC voltage control signal is smoothed by a resistor R310 and a capacitor C310 and then input to a plus terminal of an operational amplifier IC310. The voltage amplified by resistors R313 and R312 is output from an output terminal of the operational amplifier IC310.

The output terminal of the operational amplifier IC310 is connected to a drain terminal of a field-effect transistor Q310 through a resistor R311, and a source terminal of the field-effect transistor Q310 is grounded.

The output voltage of the operational amplifier IC310 is modulated by the AC clock input to a gate terminal of the field-effect transistor Q310. The AC clock is a PWM signal that has a duty cycle varying in a sinusoidal shape every 2 kHz and has a carrier frequency of 100 kHz.

The output voltage of the operational amplifier IC310 is input to a lowpass filter 315 through a capacitor C311, and is converted into a sinusoidal voltage having a frequency of 2 kHz by filter processing of the lowpass filter 315. Characteristics and a cutoff frequency of the lowpass filter 315 are set so as to obtain excellent characteristics based on a relationship between the above-described carrier frequency and the sinusoidal frequency.

The signal output from the lowpass filter 315 is amplified by an amplification circuit 316.

The output of the amplification circuit 316 is input to a step-up transformer T310 through a capacitor C312. An end, on a secondary side of the step-up transformer T310, connected to the charging unit (the charging roller) 2Y is referred to as a charging bias output end, and an end, on the secondary side of the step-up transformer T310, connected to a capacitor C313 is referred to as an AC high-voltage reference end. The capacitor C313 is disposed as a path through which an AC current output from the step-up transformer T310 flows, in the circuit. Furthermore, the DC voltage output from the above-described DC high-voltage generation circuit 202 is input to the AC high-voltage reference end.

In the AC voltage detection circuit 203, a coupling capacitor C320 first allows an AC component of the charging bias to pass therethrough to obtain a coupling waveform, in order to detect the peak-to-peak voltage Vpp of the AC high voltage. The coupling waveform is shifted in level by diodes D320 and D321. When it is assumed that a voltage drop by forward voltages of the diodes D320 and D321 is sufficiently small relative to the amplitude voltage of the AC high voltage, the maximum voltage at an anode terminal of the diode D321 corresponds to the amplitude of the AC voltage, and thus has a sine wave oscillating in a range of 0 V to 1400 V. Furthermore, the above-described sinusoidal voltage is converted into a DC waveform voltage peak-held by a capacitor C321 on a cathode terminal side of the diode D321. The peak-held DC waveform voltage is divided by resistors R320, R321, and R322 and converted into a low level voltage. The voltage subjected to the conversion is buffered by an operational amplifier IC320 after the ripple is removed by a capacitor C322, and the resultant voltage is input to the CPU 210.

Figure 4A:
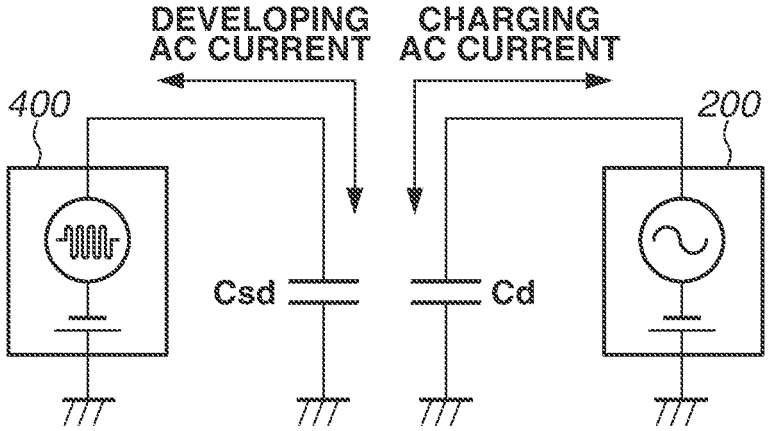
FIGS. 4A and 4B are diagrams each illustrating an equivalent circuit of a load in a charging high-voltage circuit board and a developing high-voltage circuit board according to the first exemplary embodiment.
Figure 4B:
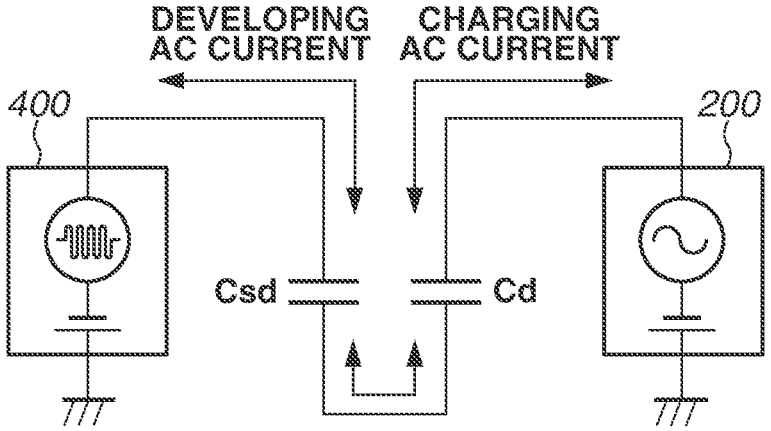

FIGS. 4A and 4B each illustrate an equivalent circuit of a load in the high-voltage circuit board 200 and the high-voltage circuit board 400. FIG. 4A illustrates a case where the drum earth terminal, which is the terminal for grounding the conductive portion of the photosensitive drum 1Y, and the housing of the image forming apparatus 100 are normally connected to each other. FIG. 4B illustrates a case where a poor connection occurs between the drum earth terminal and the housing of the image forming apparatus 100.

In the electrophotographic image forming apparatus 100, the load in the high-voltage circuit board 200 is represented by an equivalent circuit in which an electrostatic capacitance Cd of the photosensitive drum 1Y is connected in series. Likewise, the load in the high-voltage circuit board 400 is represented by a capacitance Csd due to a gap between the developing unit 4Y and the photosensitive drum 1Y. In the following description, the charging DC voltage is −600 V, the charging AC voltage is a sinusoidal voltage having an amplitude of 700 V and a frequency of 2 kHz, the developing DC voltage is −450 V, and the developing AC voltage is a square wave voltage having an amplitude of 800 V and a frequency of 10 kHz.

Figure 5A:
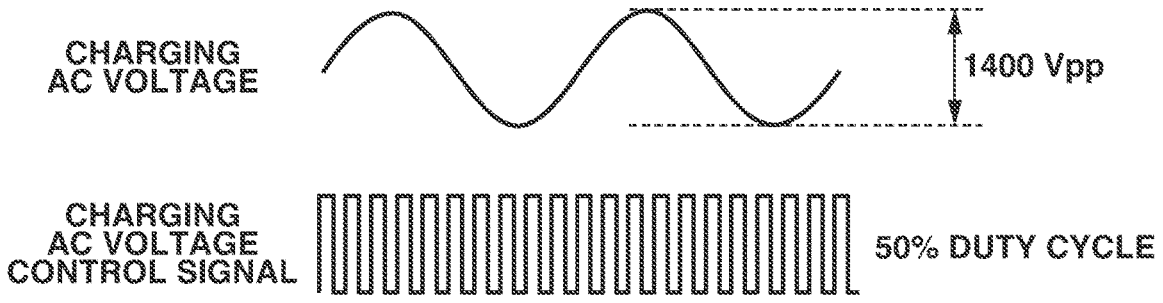
FIGS. 5A and 5B are diagrams each illustrating a charging AC voltage and a charging AC voltage control signal according to the first exemplary embodiment.

In a case where the drum earth terminal is normally connected (as illustrated FIG. 4A), a load capacitance in the high-voltage circuit board 200 is equal to the electrostatic capacitance Cd of the photosensitive drum 1 described above. A value of the electrostatic capacitance Cd is, for example, approximately 300 pF, and the current (the charging AC current) output from the high-voltage circuit board 200 through the electrostatic capacitance Cd flows to the ground (GND) through the drum earth terminal. At this time, with the feedback control of the CPU 210, the AC voltage detection value corresponds to the amplitude of the AC voltage input from the control unit 110 to the CPU 210, and the AC voltage applied to the charging roller 2Y has the peak-to-peak voltage Vpp of approximately 1400 V as illustrated in FIG. 5A. Also at this time, the duty cycle of the charging AC voltage control signal is, for example, 50%.

As described above, the load capacitance of the high-voltage circuit board 400 is equal to the capacitance Csd due to the gap between the developing unit 4 and the photosensitive drum 1. The value of the capacitance Csd is, for example, approximately 200 pF, and the AC current output from the high-voltage circuit board 400 through the developing load capacitance flows to the GND through the drum earth terminal. At this time, the developing AC voltage has the peak-to-peak voltage Vpp of approximately 1600 V.

When the drum earth terminal is normally connected and the high-voltage circuit board 200 is normal, the charging AC voltage control signal in a case where the charging AC voltage and the developing AC voltage are output has a magnitude substantially equal to a magnitude of the charging AC voltage control signal in a case where the charging AC voltage is output and the developing AC voltage is not output.

In contrast, in a case where the drum earth terminal is poorly connected and is not at the GND level (as illustrated in FIG. 4B), the photosensitive drum 1 serves as a metal body having an unfixed potential. At this time, the high-voltage circuit board 200 and the high-voltage circuit board 400 are capacitively coupled through the photosensitive drum 1. Thus, this is regarded as an equivalent circuit in which the capacitance Cd and the capacitance Csd are connected in series between the output portion of the high-voltage circuit board 200 and the output portion of the high-voltage circuit board 400. As a result, the developing AC current flows into the charging high-voltage circuit board 200. This is because the amplitude of the charging AC voltage is smaller than the amplitude of the developing AC voltage.

Figure 5B:
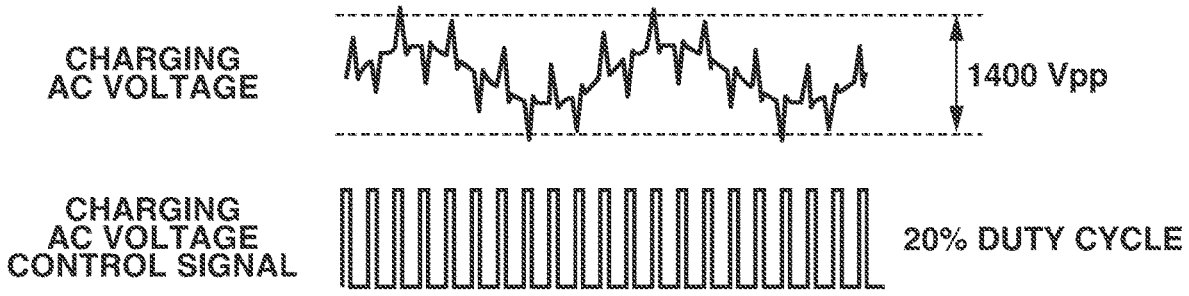

FIG. 5B illustrates an example of a waveform of the charging AC voltage in the case where the developing AC current flows into the charging high-voltage circuit board 200. The charging AC voltage illustrated in FIG. 5B has the waveform in which a high-frequency component of the square wave of the developing AC voltage is superimposed on the sine wave. At this time, the peak-to-peak voltage Vpp of the charging AC voltage transiently becomes large, but converges to 1400 V through the reduction of the charging AC voltage control signal by the feedback control of the CPU 210. At this time, the duty cycle (e.g., 20%) of the charging AC voltage control signal output from the CPU 210 is smaller than the duty cycle illustrated in FIG. 5A.

In other words, when a poor connection occurs in the drum earth terminal, the charging AC voltage control signal in the case where the charging AC voltage and the developing AC voltage are output is smaller than the charging AC voltage control signal in the case where the charging AC voltage is output and the developing AC voltage is not output, due to the flow of the developing AC current into the charging high-voltage circuit board 200.

Figure 6:
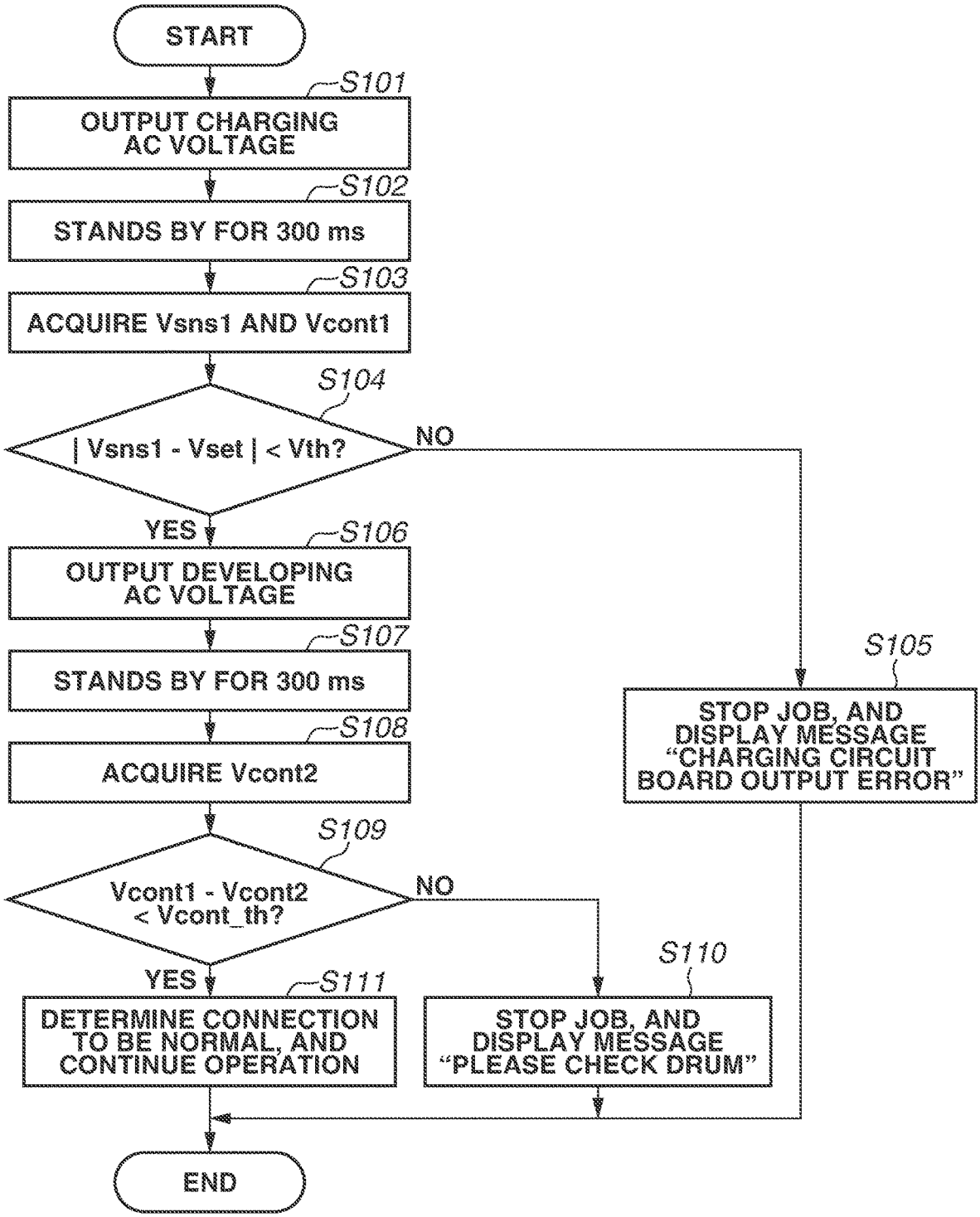
FIG. 6 is a flowchart illustrating a method for detecting a connection state of a drum earth terminal according to the first exemplary embodiment.

FIG. 6 is a flowchart illustrating a method for detecting the connection state of the drum earth terminal according to the present exemplary embodiment. Processing in the flowchart is performed by the control unit 110. The control unit 110 performs the following processing when an image formation start instruction is generated by, for example, a user pressing a print start button provided on an operation unit 500 of the image forming apparatus 100.

In step S101, the control unit 110 outputs, to the CPU 210, information about the AC clock and the AC amplitude (a charging AC amplitude setting value Vset). As a result, the AC clock and the AC voltage control signal are input from the CPU 210 to the AC high-voltage generation circuit 201, and the AC voltage is output from the AC high-voltage generation circuit 201.

In step S102, the processing stands by for 300 ms. In step S103, the control unit 110 acquires an AC voltage detection signal Vsns1 output from the AC voltage detection circuit 203 and a duty cycle Vcont1 of the AC voltage control signal output from the CPU 210. The time of 300 ms is a standby time before the charging AC voltage is raised to a set value and is stabilized by the feedback control of the CPU 210.

In step S104, in a case where a deviation between the AC voltage detection signal Vsns1 and the AC amplitude setting value Vset is greater than or equal to a predetermined value Vth (NO in step S104), the processing proceeds to step S105. In step S105, the control unit 110 stops a printing operation, and causes the operation unit 500 to display a message indicating an abnormality in the high-voltage circuit board 200. The predetermined value Vth is set to, for example, a value of 5% of the AC amplitude setting value Vset. The reason for the above-described determination will be described now. The charging AC voltage is feedback controlled by the CPU 210 so as to follow the target value irrespective of whether the drum earth terminal is poorly connected. Thus, there is no shift of the charging AC voltage due to the influence of the charging load capacitance. Accordingly, in the case where the deviation between the AC voltage detection signal Vsns1 and the AC amplitude setting value Vset is greater than or equal to the predetermined value Vth, it can be determined that the feedback control is not normally performed and the high-voltage circuit board 200 has an abnormality.

In contrast, in step S104, in a case where the deviation between the AC voltage detection signal Vsns1 and the AC amplitude setting value Vset is less than the predetermined value Vth (YES in step S104), the control unit 110 causes the high-voltage circuit board 400 to output the DC voltage at a predetermined timing.

In step S106, the control unit 110 causes the high-voltage circuit board 400 to output the developing AC voltage.

In step S107, the processing stands by for 300 ms. In step S108, the control unit 110 acquires a duty cycle Vcont2 of the AC voltage control signal output from the CPU 210. The time of 300 ms is a standby time before the current flows from the high-voltage circuit board 400 to the high-voltage circuit board 200 and the duty cycle Vcont2 in the high-voltage circuit board 200 is stabilized in the case where the drum earth terminal is poorly connected.

In step S109, in a case where a difference between the duty cycle Vcont1 and the duty cycle Vcont2 is greater than or equal to a predetermined value Vcont_th (NO in step S109), the processing proceeds to step S110. In step S110, the control unit 110 stops the printing operation, and displays a message indicating that the connection of the photosensitive drum 1 and the drum earth terminal is abnormal, on a display of the operation unit 500. In other words, a message (a notification) indicating an abnormality of the drum earth terminal is displayed. The predetermined value Vcont_th is set to, for example, a value of 5% of the duty cycle Vcont1. The reason for the above-described determination will be described now. As described above, the charging AC voltage is feedback controlled by the CPU 210 so as to converge to the target value. Thus, in the case where the difference between the duty cycle Vcont1 and the duty cycle Vcont2 is greater than or equal to the predetermined value Vcont_th, this means that the current from the outside flows into the high-voltage circuit board 200. In other words, it is considered that the state of FIG. 5B occurs. Accordingly, in this case, it can be determined that the drum earth terminal is poorly connected.

In contrast, in step S109, in a case where the difference between the duty cycle Vcont1 and the duty cycle Vcont2 is less than the predetermined value Vcont_th (YES in step S109), the processing proceeds to step S111. In step S111, the control unit 110 continues the printing operation.

As described above, in the present exemplary embodiment, the presence or absence of an abnormality in the high-voltage circuit board 200 is determined (detected) based on the detected value of the charging AC voltage at the timing (the first timing) when the charging AC voltage is output and the developing AC voltage is not output. In the case where it is determined that the high-voltage circuit board 200 has no abnormality, whether the drum earth terminal is poorly connected is determined based on the difference between the charging AC voltage control signal at the first timing and the charging AC voltage control signal at the timing (the second timing) when the charging AC voltage and the developing AC voltage are output. As described above, in the present exemplary embodiment, whether the drum earth terminal is poorly connected is determined based on the phenomenon in which the developing AC current flows into the charging control circuit board (the high-voltage circuit board 200) if the drum earth terminal is poorly connected. More specifically, the value used for the feedback control of the charging AC voltage is also used to determine whether the drum earth terminal is poorly connected. As a result, it is possible to determine whether the drum earth terminal is poorly connected, without additionally providing a configuration for detecting the current. In other words, it is possible to determine an abnormality of the earth terminal with a more inexpensive configuration and to notify the user of the abnormality.

In the present exemplary embodiment, whether the drum earth terminal is poorly connected is determined based on the duty cycle Vcont1 of the charging AC voltage control signal at the first timing and the duty cycle Vcont2 of the charging AC voltage control signal at the second timing. However, the determination method is not limited thereto. For example, whether the drum earth terminal is poorly connected may be determined based on, for example, a deviation between the duty cycle Vcont1 and the AC voltage detection signal Vsns1 at the first timing and a deviation between the duty cycle Vcont1 and the AC voltage detection signal Vsns1 at the second timing. In other words, a value corresponding to the deviation between the charging AC voltage detection value and the charging AC voltage control signal may be used to determine whether the drum earth terminal is poorly connected.

In the present exemplary embodiment, the amplitude of the charging AC voltage is set to be smaller than the amplitude of the developing AC voltage. However, the amplitude of the charging AC voltage is not limited thereto. For example, the amplitude of the charging AC voltage may be set to be greater than the amplitude of the developing AC voltage. In this case, if the drum earth terminal is poorly connected, the charging AC current flows into the developing control circuit board (the high-voltage circuit board 400). Thus, the expression in step S109 of FIG. 6 is replaced with an expression "Vcont2−Vcont1<Vcont_th?"

In the present exemplary embodiment, the AC high-voltage generation circuit 401 controls the AC voltage to be applied to the developing unit 4Y by performing the open-loop control. However, the control is not limited thereto. For example, the AC high-voltage generation circuit 401 may control the AC voltage to be applied to the developing unit 4Y by performing the feedback control in a similar manner to the control of the AC voltage to be applied to the charging unit 2Y. In this case, whether the drum earth terminal is poorly connected can be determined by using the method according to the present exemplary embodiment based on the developing AC voltage control signal for controlling the AC voltage to be applied to the developing unit 4Y.

A second exemplary embodiment will be described. A description of a configuration of the image forming apparatus 100 similar to that according to the first exemplary embodiment will be omitted.

In the first exemplary embodiment, whether the drum earth terminal is poorly connected is determined based on the difference between the charging AC voltage control signal at the first timing and the charging AC voltage control signal at the second timing. In the present exemplary embodiment, whether the drum earth terminal is poorly connected is determined based on the charging AC voltage detection signal at the second timing.

Figure 7A:
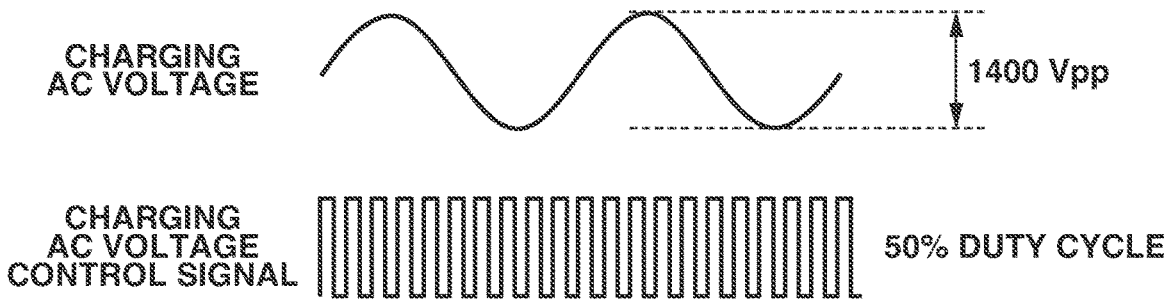
FIG. 7A is a diagram illustrating an example of the charging AC voltage and the charging AC voltage control signal in a case where the drum earth terminal is normally connected according to a second exemplary embodiment.
Figure 7B:
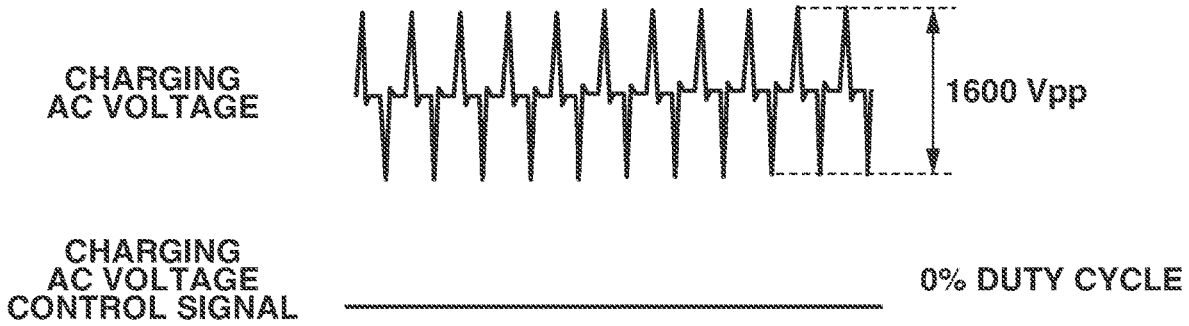
FIG. 7B is a diagram illustrating an example of the charging AC voltage and the charging AC voltage control signal in a case where the drum earth terminal is poorly connected according to the second exemplary embodiment.

FIG. 7A illustrates an example of the charging AC voltage and the charging AC voltage control signal in the case where the drum earth terminal is normally connected. FIG. 7B illustrates an example of the charging AC voltage and the charging AC voltage control signal in the case where the drum earth terminal is poorly connected. The waveform in the case where the drum earth terminal is normally connected (which is illustrated in FIG. 7A) is similar to the waveform illustrated in FIG. 5A according to the first exemplary embodiment. Thus, the description thereof will be omitted.

FIG. 7B illustrates the waveform in a case where the drum earth terminal is poorly connected and the high-frequency component of the developing AC voltage is superimposed on the charging AC voltage. A difference from FIG. 5B is that the charging AC voltage control signal is made small by the feedback control of the CPU 210 and the duty cycle finally becomes 0% (output off). At this time, the CPU 210 cannot control the charging AC voltage to correspond to the target value, and the charging AC voltage is generated by the inflow from the developing high-voltage circuit board 400. The amplitude of the charging AC voltage at this time is, for example, 800 V, and the charging AC voltage detection signal detects a value corresponding to the peak-to-peak voltage Vpp of 800 V as the amplitude of the charging AC voltage. Thus, the CPU 210 can determine, based on the charging AC voltage detection signal, that the charging AC voltage is not controlled to correspond to the target value.

The present exemplary embodiment is applied to a case where the high-frequency component of the developing AC voltage superimposed on the charging AC voltage is greater than the set value of the charging AC voltage if the drum earth terminal is poorly connected, based on a setting range of each of the charging AC voltage and the developing AC voltage, and a variation range of each of the load capacitances Cd and CSd and the slew rate of the developing AC voltage.

Figure 8:
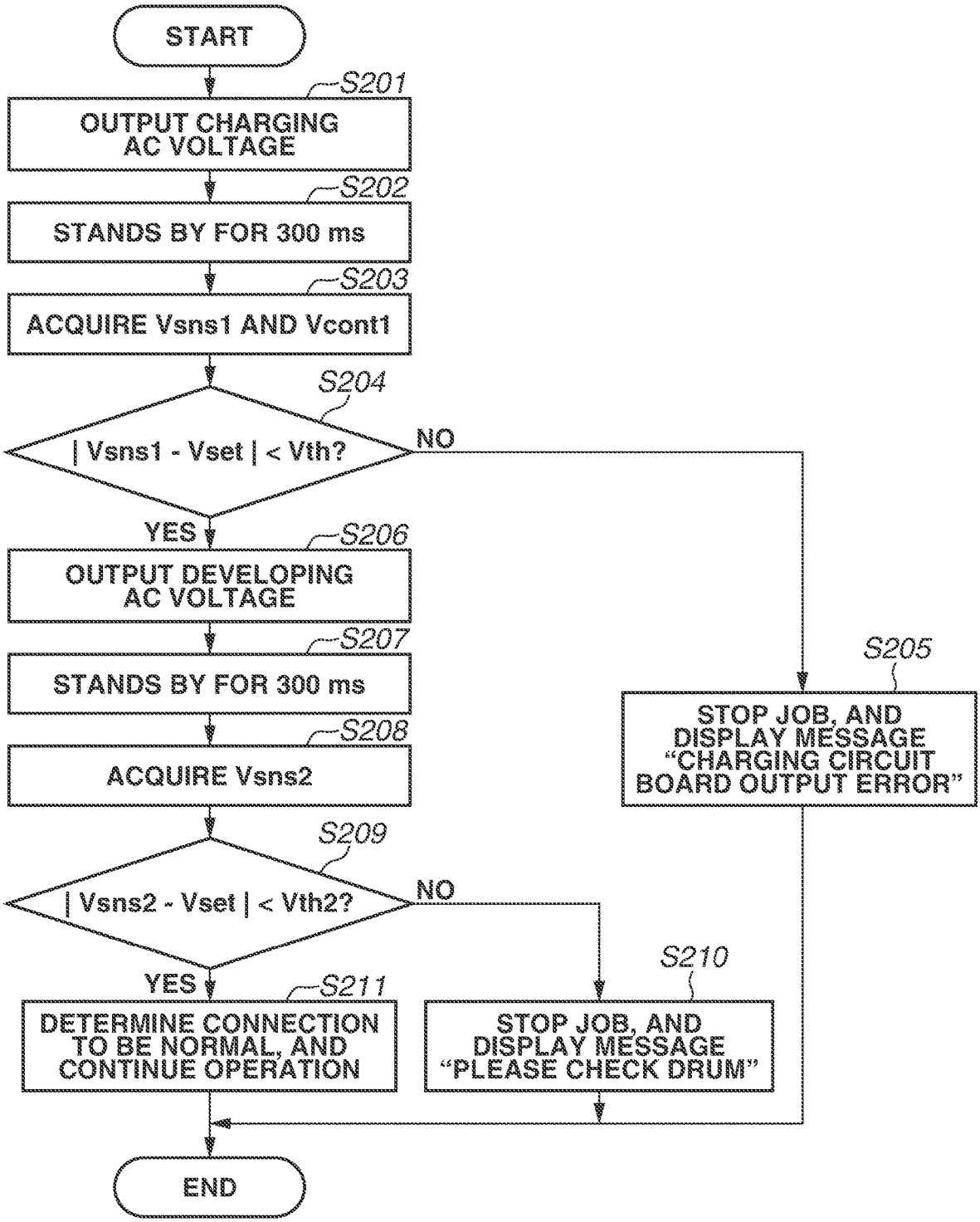
FIG. 8 is a flowchart illustrating a method for detecting a connection state of a drum earth terminal according to the second exemplary embodiment.

FIG. 8 is a flowchart illustrating a method for detecting the connection state of the drum earth terminal according to the present exemplary embodiment. Processing in the flowchart is performed by the control unit 110. The control unit 110 performs the following processing when an image formation start instruction is generated, for example, by the user pressing the print start button provided on the operation unit 500 of the image forming apparatus 100.

Processing in steps 5201 to 5207 is similar to the processing in steps 5101 to S107 according to the first exemplary embodiment. Thus, a description of the processing will be omitted.

In step 5208, the control unit 110 acquires a charging AC voltage detection signal Vsns2.

In step 5209, in a case where a deviation between the charging AC voltage detection signal Vsns2 and the charging AC amplitude setting value Vset is greater than or equal to a predetermined value Vth2 (NO in step S209), the processing proceeds to step S210. In step 5210, the control unit 110 stops the printing operation, and displays a message indicating that the connection of the photosensitive drum 1 and the drum earth terminal is abnormal, on the display of the operation unit 500. In other words, a message (a notification) indicating an abnormality of the drum earth terminal is displayed. The predetermined value Vth2 is set to, for example, a value of 5% of the charging AC amplitude setting value Vset. The reason for the above-described determination will be described now. As described above, the charging AC voltage is feedback controlled by the CPU 210 so as to converge to the target value. Thus, in the case where the deviation between the AC voltage detection signal Vsns2 and the AC amplitude setting value Vset is greater than or equal to the predetermined value Vth2, this means that the current from the outside flows into the high-voltage circuit board 200. In other words, it is considered that the state of FIG. 7B occurs. In this case, it can be determined that the drum earth terminal is poorly connected.

In contrast, in step S209, in a case where the deviation between the AC voltage detection signal Vsns2 and the AC amplitude setting value Vset is less than the predetermined value Vth2 (YES in step S209), the processing proceeds to step S211. In step S211, the control unit 110 continues the printing operation.

As described above, in the present exemplary embodiment, the presence or absence of an abnormality in the charging high-voltage substrate 200 is determined based on the value of the charging AC voltage detection signal at the timing (the first timing) when the charging AC voltage is output and the developing AC voltage is not output. In the case where it is determined that the high-voltage circuit board 200 has no abnormality, whether the drum earth terminal is poorly connected is determined based on the value of the charging AC voltage detection signal at the second timing. As a result, it is possible to determine whether the drum earth terminal is poorly connected, without additionally providing a configuration for detecting the current. In other words, it is possible to determine an abnormality of the earth terminal with a more inexpensive configuration and to notify the user of the abnormality.

In the present exemplary embodiment, the AC high-voltage generation circuit 401 controls the AC voltage to be applied to the developing unit 4Y by performing the open-loop control. However, the control is not limited thereto. For example, the AC high-voltage generation circuit 401 may control the AC voltage to be applied to the developing unit 4Y by performing the feedback control in a similar manner to the control of the AC voltage to be applied to the charging unit 2Y. In this case, whether the drum earth terminal is poorly connected can be determined based on the detected voltage of the developing unit 4Y by using the method according to the present exemplary embodiment.

In each of the first and second exemplary embodiments, notifying the user of an abnormality in the photosensitive drum 1Y via the operation unit 500 is included in the notification of information indicating an abnormality of the drum earth terminal.

According to the exemplary embodiments of the present disclosure, it is possible to determine an abnormality of the earth terminal with a more inexpensive configuration.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-016510, filed Feb. 4, 2021, which is hereby incorporated by reference herein in its entirety.

What is claimed is:

1. An image forming apparatus configured to form an image on a recording medium, the image forming apparatus comprising:

a drum unit including a conductive portion and a photosensitive body, wherein the conductive portion is provided with an earth terminal configured to ground the conductive portion by being connected to a housing of the image forming apparatus;

a charging roller configured to charge the photosensitive body based on a first alternating-current voltage;

a detector configured to detect an amplitude of the first alternating-current voltage output to the charging roller;

a controller configured to control the first alternating-current voltage to be output to the charging roller so that an amplitude deviation between the amplitude of the first alternating-current voltage detected by the detector and a target value of the amplitude of the first alternating-current voltage to be output to the charging roller is made small;

a scanning unit including a light source and configured to scan the photosensitive body charged by the charging roller, with light emitted from the light source based on the image to be formed on the recording medium;

a developing unit configured to develop an electrostatic latent image formed on the photosensitive body by the scanning unit, based on a second alternating-current voltage; and a notification unit configured to provide notification of information indicating an abnormality of the earth terminal, based on a value corresponding to a first deviation and a value corresponding to a second deviation, wherein the first deviation is the amplitude deviation in a state where the first alternating-current voltage is output to the charging roller and the second alternating-current voltage is not output to the developing unit, and the second deviation is the amplitude deviation in a state where the first alternating-current voltage is output to the charging roller and the second alternating-current voltage is output to the developing unit.

2. The image forming apparatus according to claim 1, wherein the target value of the amplitude of the first alternating-current voltage is less than an amplitude of the second alternating-current voltage to be output to the developing unit, and wherein, in a case where the value corresponding to the first deviation is less than the value corresponding to the second deviation, the notification unit provides the notification of the information indicating the abnormality of the earth terminal.

3. The image forming apparatus according to claim 1, wherein the target value of the amplitude of the first alternating-current voltage is greater than an amplitude of the second alternating-current voltage to be output to the developing unit, and wherein, in a case where the value corresponding to the first deviation is greater than the value corresponding to the second deviation, the notification unit provides the notification of the information indicating the abnormality of the earth terminal.

4. The image forming apparatus according to claim 1, wherein, in a case where the value corresponding to the first deviation is greater than a predetermined value, the notification unit provides notification of information indicating an abnormality in a circuit configured to output the first alternating-current voltage to the charging roller.

5. The image forming apparatus according to claim 1, wherein, after the first alternating-current voltage is output to the charging roller, the second alternating-current voltage is output to the developing unit.

6. The image forming apparatus according to claim 1, wherein the controller includes a switching element configured to adjust the amplitude of the first alternating-current voltage to be output to the charging roller based on the amplitude deviation, and includes a generator configured to generate a signal for switching between an on operation and an off operation of the switching element, and wherein each of the value corresponding to the first deviation and the value corresponding to the second deviation is a value corresponding to a duty cycle of the signal generated by the generator.

* * * * *